US005364694A

United States Patent [19]

Okada et al.

[11] Patent Number: 5,364,694

[45] Date of Patent: Nov. 15, 1994

[54] POLYETHYLENE TEREPHTHALATE-BASED MELTBLOWN NONWOVEN FABRIC AD PROCESS FOR PRODUCING THE SAME

[75] Inventors: Hiromasa Okada; Shoji Asano, both of Kurashiki, Japan

[73] Assignee: Kuraray Co., Ltd., Kurashiki, Japan

[21] Appl. No.: 928,459

[22] Filed: Aug. 12, 1992

[30] Foreign Application Priority Data

Aug. 13, 1991 [JP] Japan ..... 3-228708

[51] Int. Cl.[5] ..... D04H 1/58; D04H 3/16; B29C 47/00

[52] U.S. Cl. ..... 428/288; 156/166; 156/167; 264/171; 264/177.17; 264/DIG. 26; 428/296; 428/373; 428/903

[58] Field of Search ..... 428/288, 373, 903, 296; 264/171, 177.17, DIG. 26; 156/166, 167

[56] References Cited

U.S. PATENT DOCUMENTS

| | | | |
|---|---|---|---|
| 3,716,614 | 2/1973 | Okamoto et al. . | |
| 3,968,307 | 7/1976 | Matsui et al. . | |
| 4,547,420 | 10/1985 | Krueger et al. | 428/373 |
| 4,663,221 | 5/1987 | Makimura et al. . | |
| 4,818,594 | 4/1989 | Albien et al. . | |
| 4,830,904 | 5/1989 | Gessner et al. | 428/219 |
| 4,908,052 | 3/1990 | Largman et al. | 428/373 |

FOREIGN PATENT DOCUMENTS

| | | |
|---|---|---|
| 0173333 | 3/1986 | European Pat. Off. . |
| 0351318 | 1/1990 | European Pat. Off. . |
| 2178433 | 2/1987 | United Kingdom . |

OTHER PUBLICATIONS

English Translation of JP-3-045768 (Okumura et al.).

WPIL, Derwent Publications, Ltd., AN 91-105014 c 15!, & JP-A 3 045 768, Feb. 27, 1991, "Melt-Blown Non-Woven Fabric Of Polyethylene Terephthalate-With Specified Crystallinity And Thermal Shrinkage, And Is Used For Clothes, Filter Cloth For Gas Or Liquid, ETC.".

Central Patents Index, Basic Abstracts Journal, Derwent Publications, Ltd., AN 77-89360Y c 50!, & JP-A-52 132 192, Nov. 5, 1977, "Polyolefin Removal From Conjugate Fibre Of Polyolefin And Polyester-By Treatment With AQ. System Without Using Organic Solvent".

WPIL, Derwent Publications, Ltd., AN 86-260363 c 40!, & JP-A-61 186 576, Aug. 20, 1986, "Synthetic Leather Sheet-Consisting Of Very Fine Sheath-Core Fibre Molten Or Fused With Elastic Polymer".

Patent Abstracts Of Japan, vol. 012, No. 301, (C-521), Aug. 16, 1988, & JP-A-63 075 108, Apr. 5, 1988, K. Kogame, et al., "Multicomponent Fiber".

*Primary Examiner*—James D. Withers

*Attorney, Agent, or Firm*—Oblon, Spivak, McClelland, Maier & Neustadt

[57] ABSTRACT

Provided is a polyethylene terephthalate-based meltblown nonwoven fabric comprising a mixed polymer comprising 75 to 98% by weight of polyethylene terephthalate and 2 to 25% by weight of a polyolefin. The meltblown fabric has excellent thermal resistance, dimensional stability, strength and hand. Also provided is a process for producing a polyethylene terephthalate-based meltblown nonwoven fabric, which comprises melt blowing a mixed polymer comprising 75 to 98% by weight of polyethylene terephthalate and 2 to 25% by weight of a polyolefin. It is preferable that the melt blowing is conducted at a single orifice throughput of 0.2 to 1.0 g/min and under an air-jet pressure of 0.1 to 1.0 kg/cm$^2$.

13 Claims, No Drawings

POLYETHYLENE TEREPHTHALATE-BASED MELTBLOWN NONWOVEN FABRIC AD PROCESS FOR PRODUCING THE SAME

TECHNICAL FIELD

The present invention relates to a nonwoven fabric suitable for various uses, such as waddings, filters and substrates for transdermally delivered drugs and, more specifically, to a polyethylene terephthalate-based meltblown nonwoven fabric suitable for these uses and having excellent dimensional stability, thermal resistance and hand.

BACKGROUND ART

Melt-blowing process comprises extruding a molten polymer through orifices, attenuating the extrudates into fibers by action of high-temperature high-speed gas that blows from near the orifices and collecting them on a belt conveyer comprising a wire net or the like, thereby forming a nonwoven fabric. This process is known to be capable of directly producing nonwoven fabrics comprising microfine fibers that cannot be produced by other processes. One of the features of the melt-blowing process is to extrude a polymer with its melt viscosity being about one order lower than that employed upon conventional melt spinning of general-purpose fibers. It is then become necessary either to use a polymer having a lower degree of polymerization than those used for conventional melt spinning or to elevate the temperature of the polymer being extruded. Any polymer satisfying the above conditions and having threadability, i.e. fiber formability, can be used for producing meltblown nonwoven fabrics. There are thus currently produced meltblown nonwoven fabrics comprising various polyolefins, polyamides, polyesters, polyurethanes or the like. There is, however, almost no production of meltblown fabrics comprising polyethylene terephthalate (hereinafter referred to as "PET"), which is a representative of polyesters and generally has advantages in view of good qualities and low cost.

This is because of low crystallization rate of PET as compared with other crystalline polymers being used for meltblown fabrics. When extruded under the usual melt-blowing conditions, PET does not increase the crystallinity sufficiently, although it can be attenuated into fibers with no problem. Then, the resulting fibers have low thermal stability and, when placed under relaxed condition at a temperature exceeding 70°-80° C., i.e. one exceeding the glass transition temperature of the polymer, shrink to a large extent, which is a very serious problem for practical purposes. Japanese Patent Application Laid-open No. 45768/1991 proposes to solve the above problem a process which comprises appropriately heat treating under tension the web having been meltblown and collected on a belt conveyer, thereby appropriately increasing the crystallinity. This process, however, requires an additional heat treatment step and, at the same time, yields a nonwoven fabric having lower strength and being more rigid than other meltblown nonwoven fabrics from conventional readily crystallizable polymers. This is considered to be due to the tendency of meltblown polyethylene terephthalate to generate spherulites.

Even with PET, employment of very specific conditions realizes production of a web having an areal shrinkage of not more than 10% in spite of the constituting fiber having crystallized to a low crystallinity, as described in Japanese Patent Application Laid-open Nos. 90663/1980 and 201564/1989.

Thus, Japanese Patent Application Laid-open No. 90663/1980 discloses a process which comprises blowing high-pressure air (1.5 to 6 kg/cm$^2$) through an air gap having a narrow clearance of 0.2 mm or so. The process further comprises permitting the crystallization of the polymer leaving the orifice to progress by maintaining its intrinsic viscosity [$\eta$] at least 0.55, preferably at least 0.6. To this end, it is necessary to extrude the polymer at a viscosity (at least 500 poises) considerably higher than the melt viscosity range that assures good melt-blowing condition of the polymer. The PET meltblown fabric thus obtained has good properties, such as strength, hand and thermal resistance. In commercial production with a machine having a width of at least 1.5 m, it is, however, difficult to maintain such a narrow gap clearance of less than 0.3 mm uniform throughout the machine width. There would occur uneven air blow widthwise, thereby generating uneven attenuation of polymer extrudates and further variation of secondary air flow accompanying the extrudates. As a result, there occurs in the web collected on a belt conveyer a continuous weight unevenness that resembles a wind-wrought pattern on the sand so that it becomes difficult to continue the operation.

In addition, the high pressure of at least 1.5 kg/cm$^2$ of the primary air produces a large cooling effect due to adiabatic expansion. Then the PET extrudates are readily cooled and the high melting point of PET makes it difficult to produce pseudo-adhesion between the microfibers that formed. Consequently, the microfibers being collected onto the conveyer tend to scatter so that the collecting operation becomes unstable. This tendency becomes more marked with increasing polymer throughput per orifice and increasing volume of the primary air. Furthermore, with the conditions of high single orifice throughput under nigh pressure and high viscosity, shots (polymer particles) and nozzle soiling increase so that it becomes difficult to continue a long-period stable operation. To avoid this problem, a low throughput condition (0.7 to 0.2 g/orifice·minute) is necessarily employed, which lowers the productivity.

The process disclosed in Japanese Patent Application Laid-open No. 201564/1989 comprises jetting high-pressure secondary air through a narrow gap having a clearance of not more than 0.2 mm, and further using a long chamber for orientation having a length of at least 1 meter. Accordingly, this process also encounters large difficulty upon practicing with a large-width equipment on an industrial scale.

Under the above-described circumstances, no PET meltblown nonwoven fabrics are commercially produced today and costly polybutylene terephthalate, which has high crystallization rate and is hence free from the above difficulties, is used, as an only representative polyesters, for producing meltblown nonwoven fabric.

Japanese Patent Application Laid-open No. 99058/1985 proposes a process which comprises melt blowing PET in combination with another polymer. In this process, PET and PP are separately melted at different temperatures and then joined at the spinneret part, thereby forming microfine side-by-side composite fiber. In the usual melt spinning of general-purpose fiber, it is relatively easy to provide an equipment capable of joining 2 polymer flows at the spinneret part.

With spinnerets for melt-blowing purpose, which must include passages for blowing air and arrange orifices in substantially one line only, provision of such joining device however renders the entire spinning head too complex so that the number of orifices should be extremely reduced, thereby decreasing the productivity. Furthermore, the microfiber obtained by this process is, like those in meltblown fabrics comprising PET only, not provided with increased crystallization rate. As a result, the thermal stability of such fiber is not improved.

In view of the above problems, the present inventors have made intensive studies to obtain, using PET, stably and efficiently, a meltblown nonwoven fabric having the excellent properties of PET, and completed the invention.

DISCLOSURE OF THE INVENTION

Accordingly, an object of the present invention is to provide a meltblown nonwoven fabric having all of the high strength, thermal dimensional stability and good hand with flexibility of PET.

Another object of the present invention is to provide a process for producing the above meltblown nonwoven fabric stably and efficiently.

The present invention provides a polyethylene terephthalate-based meltblown nonwoven fabric comprising a mixed polymer comprising 75 to 98% by weight of polyethylene terephthalate and 2 to 25% by weight of a polyolefin.

The present invention also provides a process for producing a polyethylene terephthalate-based nonwoven fabric, which comprises melt blowing a mixed polymer comprising 75 to 98% by weight of polyethylene terephthalate and 2 to 25% by weight of a polyolefin.

BEST MODE FOR CARRYING OUT THE INVENTION

The key feature of the present invention lies in obtaining at high productivity a meltblown nonwoven fabric comprising microfine fiber and having excellent dimensional stability, thermal resistance and hand. The invention is explained in more detail now.

PET cannot give a meltblown fabric with small thermal shrinkage unless melt-blowing operation is conducted at higher viscosity and with air under higher pressure than these melt-blowing conditions employed for other readily-crystalline polymers such as polypropylene. As described before, stable operation with high productivity is impossible under such strict conditions. The present inventors have studied to solve these problems while using a comparatively low pressure air. It has been found that blending with PET an appropriate amount of a polyolefin, which is incompatible with PET and has high crystallization rate and sufficiently low melt viscosity, can produce "viscosity-reducing effect" that decreases the melt viscosity of the entire blend, which facilitates attenuation of PET into fibrous form, thereby being able to obtain the desired meltblown nonwoven fabric. If a polymer having similar chemical structure to that of PET, such as PBT which is also classified as a polyester, is blended with PET, the object cannot be achieved. This is considered to be due to the fact that similarity of chemical structure inhibits the crystallizing function of the two component. Blending of 2 to 25% of a polyolefin was found to be most effective for achieving the above object. Examples of the polyolefin are polyethylene (particularly LL-PE), polypropylene (PP) and polymethylpentene (PMP), among which most preferred are polypropylene and polymethylpentene which give good fiber formability under low melt viscosity conditions. Further among various polyolefins those having a low melt viscosity are preferred for production of sufficient "viscosity-reducing effect". Thus, for example in the case of polypropylene, preferably used are those having a melt index at 230° C. of at least 100.

The mechanism, in the present invention, of providing a nonwoven fabric having good thermal dimensional stability is that blending 2 to 25% of a polyolefin with PET decreases the melt viscosity of the entire blend so that the polymer extrudates can be attenuated into fibers even by the comparatively weak force exerted by a low-pressure air of not more than 1.0 kg/cm$^2$. The polyolefin blended is present in the form of minute islands dispersed in the continuous sea of PET, and each of the islands crystallizes separately to a suitable extent. A multiplicity of the thus crystallized island constitute, when the meltblown fabric is heated, restricting points that suppress movement of amorphous molecules, thereby preventing the nonwoven fabric from shrinking to a large extent. Differential thermal analysis on the meltblown fabric reveals presence of crystal-melting endothermic peaks each corresponding to PET and the polyolefin used.

If the polyolefin is blended in too small an amount, the melt viscosity of the entire blend will not decrease sufficiently and cause the following troubles. That is, it becomes difficult to attenuate by a weak force of low pressure air the extruded masses sufficiently into fibers. Even when the air is blown in a considerably large amount, orientation crystallization of PET does not proceed smoothly. As a result, the obtained nonwoven fabric, having small thermal shrinkage though, suffers sticking between fibers when heat treated by heat calendering or the like at a temperature of not lower than the glass transition point of PET, thereby becoming of a paper-like, rigid hand. A still larger amount of the air blown tends to cause the fibers in the collected web to scatter so that it becomes difficult to collect the fibers stably. In view of the foregoing, the lower limit of the amount blended of the polyolefin used is 2% by weight. On the other hand, if the blend ratio of a polyolefin is too large, it will become difficult to disperse the polyolefin uniformly and finely in PET. Then, the fiber formability will, like in the case of conventional blend spinning, decrease and the extruded masses will not be sufficiently attenuated, thereby causing frequent fiber breakages and rendering it difficult to obtain a meltblown nonwoven fabric stably. Such being the case, the amount blended of the polyolefin used should be not more than 25% by weight, preferably not more than 20% by weight.

It is necessary to disperse the polyolefin in PET finely and nearly homogeneously. This is because presence of the polyolefin in the form of large blocks in PET due to nonuniform blending tends to generate what is known as "shots" caused by poor attenuation, thereby making it impossible to conduct stable melt blowing. Any blending process may be employed insofar as it can disperse the polyolefin used finely and nearly homogeneously in PET. It is, however, desirable to employ, for the purpose of achieving uniform blending, a process which comprises melt kneading a blend of 2 groups of pellets mixed in a prescribed ratio, or a process which comprises kneading the 2 components and then pelletizing the kneaded mass. These processes do not require any special apparatus and can advantageously use the usual melt-blowing equipment for single-component fabrics.

The process of the present invention can be practiced with the usual spinning head without any particular modification, such as narrowing the gap for blowing air.

According to the process of the present invention, thanks to sufficient decrease in the melt viscosity of the blended polymer, stable melt blowing can be conducted at a high single orifice throughput of 0.2 to 1.0 g/min while a low pressure air of not more than 1.0 kg/cm$^2$ is used. A further decrease in the throughput can still assure stable melt blowing, but it leads to low productivity. On the other hand, with the single orifice throughput exceeding 1.0 g/min, sufficient attenuation cannot be achieved with the low pressure air unless the air is used in a large amount. Such large amount of air, however, will cause the afore-described problem so that stable operation becomes difficult. It is preferred that the air pressure be at least 0.1 kg/cm$^2$ since lower one cannot assure sufficient attenuation.

The temperature at which the polymers are melt and the spinning head temperature are preferably as low as possible and such that the melt viscosity of the entire blend at the spinning head becomes 200 to 500 poises.

The meltblown web thus obtained has an average fiber diameter of, varying depending on the single orifice throughput, air pressure, spinning head temperature and like conditions though, generally not more than 10$\mu$. Webs of crystallized microfine fibers having an average fiber diameter of 1 to 3$\mu$ can be produced stably. These meltblown webs heat shrink only to a small extent because of appropriate crystallization of PET fiber and generally have a dry heat shrinkage (areal shrinkage) as measured after heating with hot air at 120° C. for 2 minutes of not more than 10%.

According to the present invention, it has become possible to produce stably and at a low cost meltblown fabrics having good thermal resistance, dimensional stability, strength and hand. The nonwoven fabrics thus produced are effectively used for various applications such as waddings for clothing, heat-resistant filters and substrates for transdermally delivered drugs.

EXAMPLES

Other features of the invention will become apparent in the course of the following description of exemplary embodiments which are given for illustration of the invention and are not intended to be limiting thereof. In the Examples that follow, "parts" and "%" mean "parts by weight" and "% by weight", respectively, unless otherwise specified.

Examples 1 through 5 and Comparative Examples 1 and 2

There were prepared blends in the form of pellets comprising a PET having an intrinsic viscosity of 0.62 and a polypropylene having a melt index of 200 in blending ratios as shown in Table 1. The blends were each heat melted through an extruder and extruded downwardly through a melt-blowing nozzle having a die width of 2,000 mm and having 2,001 orifices having a diameter of 0.3 mm and arranged in a line with a pitch of 1 mm. Heated air was jetted through an air gap having a clearance of 1 mm to attenuate the extruded masses and the fibers formed were collected on a wire net belt conveyer running horizontally below the die, to form meltblown webs. The webs thus obtained were tested for dry heat areal shrinkage at 120° C. The webs were also embossed at 180° C. to a pressing area of 15% and then subjected to tensile test. The results are shown in Table 1.

TABLE 1

| | Example 1 | Example 2 | Example 3 | Example 4 | Example 5 | Comp. Ex. 1 | Comp. Ex. 2 |
|---|---|---|---|---|---|---|---|
| Blending ratio of PP (wt %) | 20 | 10 | 5 | 2.5 | 24 | 0 | 29 |
| Single-orifice throughput (g/min) | 0.35 | 0.30 | 0.20 | 0.20 | 0.35 | 0.20 | 0.30 |
| Melting temp. for polymer (°C.) | 301 | 300 | 301 | 303 | 301 | 301 | 302 |
| Melt viscosity of polymer* (poises) | 292 | 358 | 403 | 473 | 266 | 620 | 231 |
| Air pressure (kg/cm$^2$) | 0.43 | 0.55 | 0.55 | 0.62 | 0.40 | 0.66 | 0.1–0.9 |
| Air temperature (°C.) | 299 | 299 | 299 | 299 | 299 | 299 | 299 |
| Air flow rate/ polymer flow rate** | 56 | 69 | 103 | 121 | 49 | 144 | 10–100 |
| Areal shrinkage at 120° C. (%) | 1.8 | 3.0 | 3.0 | 8.6 | 1.3 | 31.0 | Too frequent fiber breakage; no web could be obtained. |
| Weight (g/m$^2$) | 70 | 69 | 70 | 70 | 70 | Could not be embossed. | |
| Strength (g/cm/g/m$^2$) | 12.9 × 11.7 | 15.9 × 14.0 | 23.3 × 14.1 | 22.9 × 16.3 | 12.2 × 10.9 | | |
| Elongation (%) | 64 × 65 | 77 × 83 | 43 × 53 | 48 × 49 | 66 × 59 | | |

*Measured on the polymer just passing the orifice.
**Ratio between the volumes per unit time.

As is apparent from Table 1, it is difficult, without blending PP, to obtain a nonwoven fabric having satisfactory properties with a low pressure air of not more than 1 kg/cm$^2$. On the other hand, there were able to be obtained according to the present invention meltblown nonwoven fabrics having good dimensional stability and hand and sufficient strength. These nonwoven fabrics according to the present invention exhibited, though not shown in the table, dry heat areal shrinkages even at 180° C. for 2 minutes of not more than 10%, thus proving their sufficient thermal resistance. It is also noted that, within the scope of the present invention, smaller blending ratio of PP leads to larger amount of required air and lower productivity and operation stability.

Obviously, numerous modifications and variations of the present invention are possible in light of the above teachings. It is therefore to be understood that within the scope of the appended claims, the invention may be practiced otherwise than as specifically described herein.

We claim:

1. A polyethylene terephthalate-based meltblown nonwoven fabric comprising a mixed polymer comprising 75 to 98% by weight of polyethylene terephthalate and 2 to 25% by weight of a polyolefin, wherein the polyolefin is present, in the cross-section of the fibers, in the form of microfine islands uniformly and nearly homogeneously dispersed in a sea of the polyethylene terephthalate.

2. A polyethylene terephthalate-based meltblown nonwoven fabric according to claim 1, further having a dry heat areal shrinkage at 120° C. of not more than 10%.

3. A polyethylene terephthalate-based meltblown nonwoven fabric according to claim 1, wherein said polyolefin is polypropylene.

4. A polyethylene terephthalate-based meltblown nonwoven fabric according to claim 1 , wherein said polyolefin is polyethylene.

5. A polyethylene terephthalate-based meltblown nonwoven fabric according to claim 1, wherein said polyolefin is polymethylpentene.

6. A process for producing a polyethylene terephthalate-based meltblown nonwoven fabric, which comprises melt blowing a mixed polymer of a uniformly and nearly homogeneously blended mixture comprising 75 to 98% by weight of polyethylene terephthalate and 2 to 25% by weight of a polyolefin.

7. A process for producing a polyethylene terephthalate-based meltblown nonwoven fabric according to claim 6, wherein the melt blowing is conducted under an air-jet pressure of 0.1 to 1.0 kg/cm$^2$.

8. A process for producing a polyethylene terephthalate-based meltblown nonwoven fabric according to claim 6, wherein the melt blowing is conducted at a single orifice throughput of 0.2 to 1.0 g/min.

9. A process for producing a polyethylene terephthalate-based meltblown nonwoven fabric according to claim 6, wherein said mixed polymer is obtained by mixing pellets of said polyethylene terephthalate and said polyolefin.

10. A process for producing a polyethylene terephthalate-based meltblown nonwoven fabric according to claim 6, wherein said mixed polymer is obtained by melt blending of pellets of said polyethylene terephthalate and said polyolefin and then forming the resulting blend again into pellets.

11. A process for producing a polyethylene terephthalate-based meltblown nonwoven fabric according to claim 6, wherein said polyolefin is polypropylene.

12. A process for producing a polyethylene terephthalate-based meltblown nonwoven fabric according to claim 6, wherein said polyolefin is polyethylene.

13. A process for producing a polyethylene terephthalate-based meltblown nonwoven fabric according to claim 6, wherein said polyolefin is polymethylpentene.

* * * * *

UNITED STATES PATENT AND TRADEMARK OFFICE

CERTIFICATE OF CORRECTION

PATENT NO. : 5,364,694

DATED : November 15, 1994

INVENTOR(S) : Hiromasa OKADA, et al.

It is certified that error appears in the above-indentified patent and that said Letters Patent is hereby corrected as shown below:

On the title page, Item [54] and Column 1, Lines 2-4, the title should read as follows:

--POLYETHYLENE TEREPHTHALATE-BASED MELTBLOWN NONWOVEN FABRIC AND PROCESS FOR PRODUCING THE SAME--

Signed and Sealed this

Twenty-eight Day of March, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,364,694

DATED : November 15, 1994

INVENTOR(S) : Hiromasa Okada et al

It is certified that error appears in the above-identified patent and that said Letters Patent is hereby corrected as shown below:

| COL. | LINE | |
|---|---|---|
| 2, | 38, | delete "nigh" and insert --high--; |
| 2, | 42, | delete "0.7 to 0.2" and insert --0.1 to 0.2--; |
| 5, | 22, | insert --,-- between "$cm^2$ and since"; |
| 6, | 12, | delete "2" from the center of the line, an insert --2-- on the left side. |

Signed and Sealed this

Thirteenth Day of June, 1995

*Attest:*

Bruce Lehman

BRUCE LEHMAN

*Attesting Officer*

*Commissioner of Patents and Trademarks*